US005377720A

United States Patent [19]

Stobbs et al.

[11] Patent Number: 5,377,720

[45] Date of Patent: Jan. 3, 1995

[54] PROPORTIONAL PRESSURE REDUCING AND RELIEVING VALVE

[75] Inventors: Thomas J. Stobbs, Brookfield; James R. Ward, Milwaukee, both of Wis.

[73] Assignee: Applied Power Inc., Butler, Wis.

[21] Appl. No.: 154,235

[22] Filed: Nov. 18, 1993

[51] Int. Cl.[6] ..... F15B 13/044

[52] U.S. Cl. ..... 137/625.65; 137/625.68

[58] Field of Search ..... 137/625.65, 625.68

[56] References Cited

U.S. PATENT DOCUMENTS

| | | | |
|---|---|---|---|
| 4,917,150 | 4/1990 | Koch et al. | 137/625.65 |
| 5,184,644 | 2/1993 | Wade | 137/625.61 |
| 5,299,600 | 4/1994 | Aronovich | 137/625.65 |

OTHER PUBLICATIONS

Applicant's Exhibit 1, page entitled "Atos spa" Proportional pressure reducing valves type RZE, Table F010-4/E and attached sketch, admitted prior art.

*Primary Examiner*—Gerald A. Michalsky

*Attorney, Agent, or Firm*—Quarles & Brady

[57] ABSTRACT

A hydraulic pressure reducing and relieving valve has a body with input, control and relief ports, a tubular spool slidably received within the body for selectively providing communication between the ports, and a tubular quill within the spool which the spool can slide over. The quill has a lumen which provides communication from one end of the spool to the other, so as to pressure balance the spool with relief pressure, and together with the spool defines a feedback chamber in communication with the control port which generates a force on the spool which opposes the operating force exerted on the spool by a solenoid. The spool may also be biased by a spring in the feedback chamber.

7 Claims, 2 Drawing Sheets

110
112
114
116
118
118a
118b
120
122
124
126
128a
128b
130a
130b
132a
132b
134
136
138
144
146
148
150
152
154
161
163
165
167
169
170
171
173
174
175
177
184
186
188
190
192
194

210
214
216
218
218a
220
222
224
226
228a
228b
230a
230b
232a
232b
234
236
238
244
246
248
250
252
254
260
262
264
270
274
280
282
284
286
288
292
294
298
299
300

PROPORTIONAL PRESSURE REDUCING AND RELIEVING VALVE

FIELD OF THE INVENTION

This invention relates to a valve for selectively providing communication between a control port and an inlet pressure port or a relief port, and in particular to such a valve in which a feedback pressure acts on a valve spool to oppose the operating force exerted on the valve spool.

BACKGROUND OF THE INVENTION

Pressure reducing and relieving valves with feedback are well known and used in many different automotive and other applications. For example, such valves have been applied to vehicular braking, steering, transmission and suspension systems.

In general, pressure reducing and relieving valves are used to selectively communicate a pressure port to be controlled with either a pressure inlet or a pressure relief port. The degree of communication between the control pressure port and either the inlet port or relief port is proportionally variable in many cases, for example by the use of a solenoid which acts against a spring. In many of these valves, a pressure from the control port is plumbed within the valve so as to exert a force on the valve spool which opposes the solenoid force, and the valve spool is balanced by the relief pressure.

Prior pressure reducing and relieving valves often required complex machining operations which contributed to a relatively high cost of such valves. The present invention provides a pressure reducing and relieving valve with few parts and relatively simple machining operations required to reduce the cost and complexity of manufacturing such valves.

SUMMARY OF THE INVENTION

The invention provides a pressure reducing and relieving valve with a valve body which has a pressure inlet port, a pressure relief port, a control port and an axial main bore. A main spool is slidably received in the main bore and is tubular from end to end, defining within it a sub-bore which is co-axial with the main bore. The main spool is axially moveable between a first position in which communication is established between the relief and control ports and a second position in which communication is established between the inlet and control ports. A quill is slidably received in the sub-bore and has a passageway extending through it so as to establish communication through the quill from one end of the main spool to the other end. Means are provided for exerting an operating force on the main spool for moving the main spool from one of the first and second positions to the other position. A feedback pressure chamber is defined between the quill and the main spool which is in communication with the control port and exerts an axial force on the main spool which opposes the operating force. With this construction, the main spool is balanced from end to end by the communication provided through the quill. This avoids machining the body or other passageways which would be necessary to pressure balance the spool and results in a design which is economical to manufacture.

Preferably, biasing means are provided between the quill and the main spool for exerting a biasing force on the main spool which opposes the operating force. In an especially useful aspect, the biasing means is located in the feedback pressure chamber.

DETAILED DESCRIPTION OF THE PREFERRED EMBODIMENTS

Figure 1:
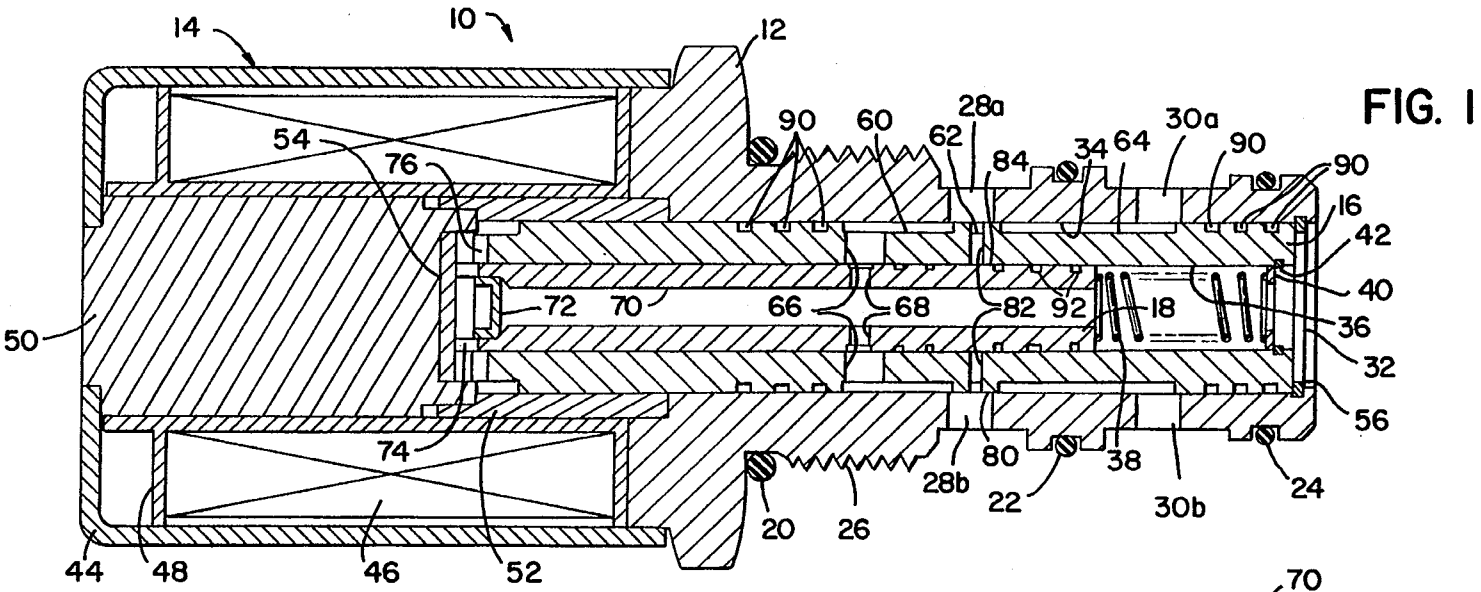
FIG. 1 is a cross-sectional view of a first embodiment of a pressure reducing and relieving valve of the invention.

Referring to FIG. 1, a valve 10 of the invention has a body 12, a coil sub-assembly 14, a main spool 16 and a quill 18. O-rings 20, 22 and 24 are provided around the body 12 at spaced locations to provide seals between the body 12 and a valve bore (not shown) into which the valve 10 is assembled. The body 12 has threads 26 for securing the valve 10 in the valve bore.

The body 12 has control ports **28*a* and 28*b*, pressure inlet ports 30*a* and 30*b* and a relief port 32. The control ports, the inlet ports and the relief port are separated from one another by the O-rings 22 and 24 when the valve 10 is received in the valve bore as described above. Therefore, the only communication between these ports is provided inside the valve body 12**.

The valve body 12 is tubular and defines within it a main bore 34. Slidably received in the main bore 34 is the main spool 16, which also is tubular and defines within it a sub-bore 36. Slidably received in the sub-bore 36 is the quill 18 and a spring 38 extends between the end of the quill 18 and a washer 40 which is secured in the main spool 18 by a spring clip 42.

The spring 38 exerts an axial force on the main spool 16 which opposes the electromagnetic operating force exerted on the main spool 16 by the coil sub-assembly 14. The coil sub-assembly 14 includes a stainless steel cover 44, a coil 46 and a bobbin 48. A steel pole piece 50 is brazed to a non-magnetic stainless steel sleeve 52 which is brazed to body 12 and inside of which the main spool 16 is slidably received. The coil sub-assembly 14 is press fit to the body 12 and core 50 to create a moisture-proof connection therewith. Also, a stainless steel plate 54 resides between the leftward end of quill 18 and the pole piece 50 so as to resist residual magnetism between the pole piece 50 and the main spool 16, which may otherwise prevent the return of the main spool 16 to its normal position under the bias of spring 38. Also, a spring clip 56 captured in the end of the body 12 holds the main spool 16 inside the main bore 34 of the body 12.

The main spool 16 has three circumferential grooves 60, 62 and 64 formed in it. In the normal position of the main spool 16 shown in FIG. 1, in which there is no current applied to the coil 46, the groove 60 is in communication with the control ports **28*a,b*. Fluid under pressure from the control ports 28*a,b* can flow into the groove 60 into cross-bore 66 in the main spool 16 and into cross-bore 68 in the quill 18 to the interior lumen 70 of the quill 18, which is in communication with the relief port 32. Thus, in the normal position of the main spool 16, the tank port 32 and the control ports 28*a,b* are in communication with one another and are not in communication with the inlet ports 30***a*, 30*b*.

At the opposite end of the lumen 70, an orifice plate 72 having an orifice formed therein is pressed into the quill 18. The end of the quill 18 is slotted at 74 and the end of the spool 16 is slotted at 76 so as to allow for fluid flow past them. The orifice plate 72 provides for damping of the pressure changes at the left end of the quill 18. The communication provided through the orifice plate 72 and quill 18 allows for balancing of the pressures acting at the left and right ends of the main spool 16 and plate 18 to be equal to the pressure at the relief port 32.

As the current supplied to the coil 46 is increased, the operating force exerted by the coil 46 eventually overcomes the force of the spring 38 and the main spool 16 begins to move leftwardly toward the pole piece 50. The distance that the main spool 16 moves is dependent upon the magnitude of the current applied to the coil 46. When the main spool 16 has moved leftwardly a sufficient distance so as to align land 80 (on both sides of groove 62) of main spool 16 with the ports 28*a,b*, communication between the ports 28*a,b* and both the relief port 32 and the inlet ports 30*a,b* is cut off. In this position, all ports are blocked. Further leftward movement of the main spool 16 keeps communication between the control ports 28*a,b* and the relief port 32 cut off, but opens communication via circumferential groove 64 between the inlet ports 30*a,b* and the control ports 28*a,b*. The degree of communication between these ports is determined by the magnitude of the current supplied to the coil 46.

Figure 2:
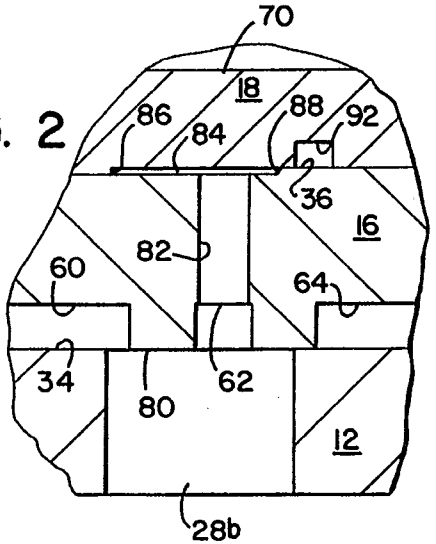
FIG. 2 is a detail view of a portion of the valve of FIG. 1.

The circumferential groove 62 is formed in the land 80 and in all positions of the main spool 16 is in communication with the control ports 28*a,b*. In addition, one or more cross-bores 82 are formed in the main spool 16 to provide communication between the circumferential groove 62 and the sub-bore 36. The cross-bore 82 opens in the sub-bore 36 into an annular feedback pressure chamber 84 (FIG. 2) which is defined between the main spool 16 and the quill 18. In the area of the feedback pressure chamber 84, the quill 18 is reduced in external diameter and the main spool 16 is enlarged in internal diameter, creating the feedback pressure chamber 84 between the reduced and enlarged diameters.

A generally axially facing annular reaction pressure surface 86 is formed on the exterior of the quill 18 at the left end of the chamber 84 and a feedback pressure surface 88 is formed on the interior of the main spool 16 at the right end of the chamber 84. Thus, a pressure in the feedback pressure chamber 84 exerts a force on the feedback pressure surface 88 of the main spool 16 which acts rightwardly as shown in FIG. 1, which opposes the force exerted on the main spool 16 by the coil 46. Thus, the feedback pressure force exerted on the main spool 16 tends no move the spool back towards its normal position in which communication between the relief and control ports is open and communication between the inlet and control ports is closed.

Annular grooves 90 and 92 are provided around the respective main spool 16 and quill 18 so as to circumferentially equalize pressures acting on their respective main spool 16 and quill 18 caused by leakage of fluid, as is well known in the art.

Figure 3:
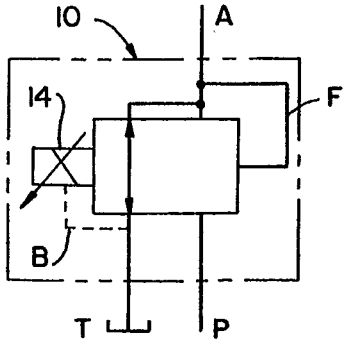
FIG. 3 is a schematic diagram of the valve of FIG. 1.

FIG. 3 schematically illustrates the valve 10 shown in FIG. 1. In FIG. 3, the designation "A" corresponds to the control ports 28*a,b*, the designation "P" corresponds to the inlet ports 30*a,b*, and the designation "T" corresponds to the relief port 32. The schematic illustration of FIG. 3 shows the valve 10 in its normal position. Line B in FIG. 3 indicates that the main spool is balanced by tank pressure and line F in FIG. 3 indicates that the main spool is biased toward its normal position by a feedback pressure.

Figure 4:
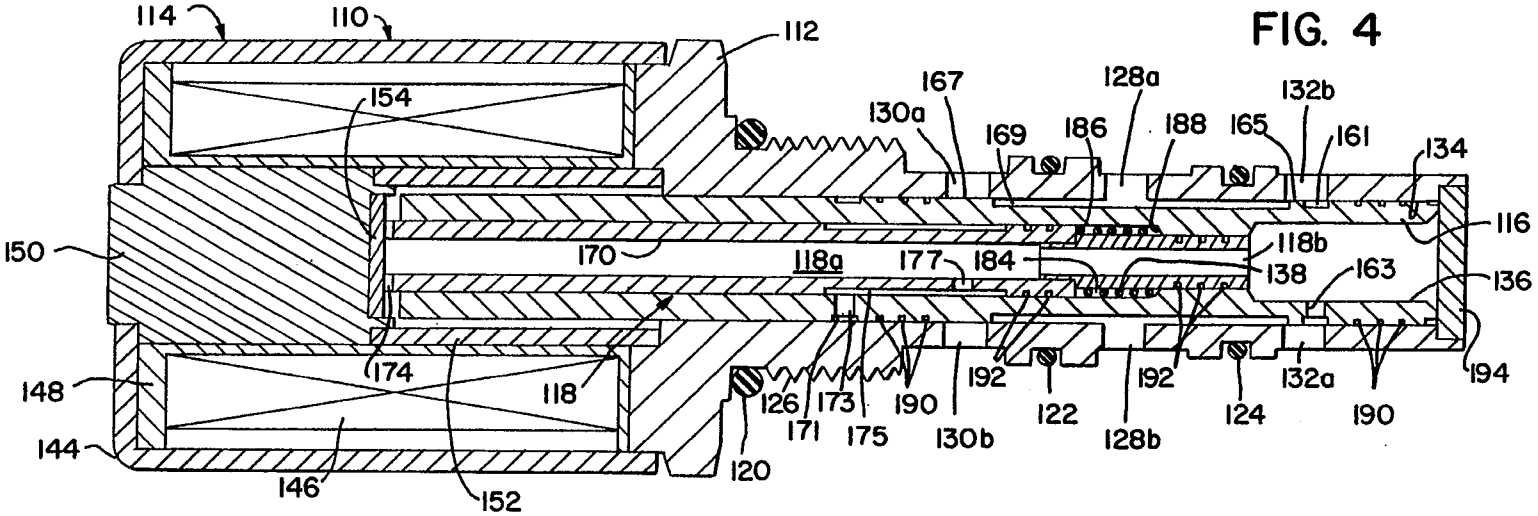
FIG. 4 is a sectional view of a second embodiment of a pressure reducing and relieving valve of the invention.

FIG. 4 illustrates an alternate embodiment 110 of a valve of the invention. The valve 110 is essentially the same as the valve 10 and corresponding parts of the valve 110 are designated by the same reference numbers as used for the valve 10, plus 100.

Essentially the only differences between the valve 110 and the valve 10 are that the relief port is repositioned from the end of the valve body to a cross-bore position indicated by 132*a*, 132*b*, the quill 118 is made in two pieces 118*a* and 118*b*, the spring 138 is positioned in the feedback pressure chamber 184, and the leftward end of the main bore 134 is sealed off by a plate 194. The two pieces 118*a* and 118*b* of the quill are secured together by an interference fit and the feedback chamber 184 is defined at the end of part 118*a* and radially outside of part 118*b*. The spool 116 is balanced by the relief pressure from ports 132*a,b*, which is communicated to the lumen 170 through circumferential groove 161 and crossbore 163. Land 165 serves to seal off communication between the ports 128*a,b* and ports 132*a,b* when the spool 116 is moved leftwardly (as viewed in FIG. 4) and land 167 seals off communication between ports 128*a,b* and ports 130*a,b* when the spool is moved rightwardly. A circumferential groove 169 extends between the lands 165 and 167. Circumferential groove 171, crossbore 173, circumferential groove 175 and crossbore 177 are provided in the main spool 116 and quill 118 to provide for relief of fluid leaking past the circumferential surfaces of the main spool 216 and quill 218 to the relief ports 132*a* and 132*b*. An orifice plate (72 in the valve 10) is optional, and none is provided in the valve 110. Like the valve 10, the valve 110 is functionally represented by the schematic circuit of FIG. 3.

Figure 5:
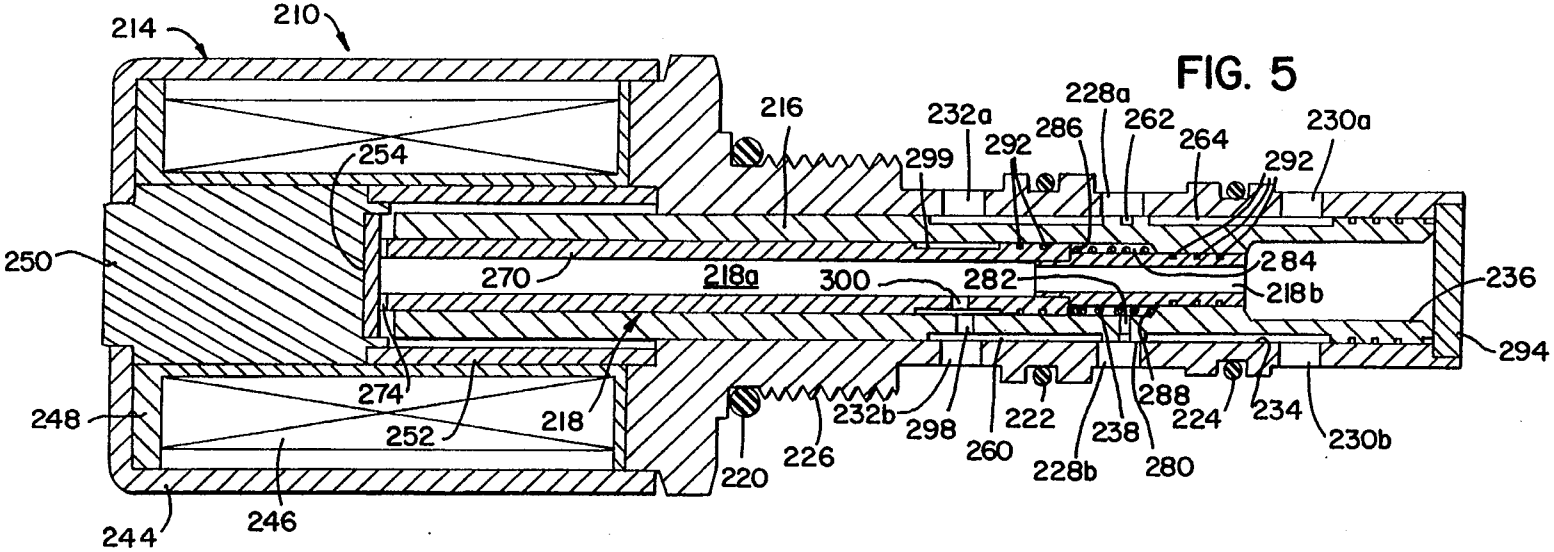
FIG. 5 is a sectional view of a third embodiment of a pressure reducing and relieving valve of the invention.

A third embodiment 210 is shown in FIG. 5 which is essentially the same as the embodiment 10 and the embodiment 110. In the embodiment 210, elements corresponding to elements of the embodiment 10 are designated by the same reference numerals plus 200.

In the embodiment 210, the relief ports 232*a* and 232*b* are moved closer to the rightward end of the valve body 212. Also, a circumferential groove 297, crossbore 298, circumferential groove 299 and cross-bore 300 are provided in the main spool 216 and quill 218 to provide for communication between tank ports 232*a,b* and lumen 270.

preferred embodiments of the invention have been described in considerable detail. Numerous modifications and variations will be apparent to those of ordinary skill in the art which will still incorporate the spirit of the invention. For example, although all of the embodiments described and illustrated above are normally closed from the inlet port to the control port, a valve having normally open communication between the inlet port and the control port could be made incorporating the invention. Therefore, the invention should not be limited to the embodiments described but should be defined by the claims that follow.

We claim:

1. A pressure reducing and relieving valve, comprising:

a valve body having a pressure inlet port, a pressure relief port and a control port, said valve body defining an axial main bore;

a main spool slidably received in said main bore, said main spool being tubular from end to end and defining within it a sub-bore which is co-axial with said main bore, said main spool being axially moveable between a first position in which communication is established between said relief and control ports and a second position in which communication is established between said inlet and control ports;

a quill slidably received in said sub-bore, said quill having a passageway extending therethrough so as to establish communication through said quill from one end of said main spool to the other end of said main spool; and means for exerting an operating force on said main spool for moving said main spool from one of said first and second positions to the other said position;

wherein a feedback pressure chamber is defined between said quill and said main spool, said feedback pressure chamber being in communication with said control port and exerting an axial force on said main spool which opposes said operating force.

2. A pressure reducing and relieving valve as claimed in claim 1, further comprising biasing means between said quill and said main spool for exerting a biasing force on said main spool which opposes said operating force.

3. A pressure reducing and relieving valve as claimed in claim 2, wherein said biasing means is located in said feedback pressure chamber.

4. A pressure reducing and relieving valve as claimed in claim 1, wherein said passageway of said quill is in communication with said relief port.

5. A pressure reducing and relieving valve as claimed in claim 4, wherein said quill is tubular and defines within it an interior lumen, and said passageway includes said lumen.

6. A pressure reducing and relieving valve as claimed in claim 1, wherein in a third position of said main spool which is between said first and second positions, communication is cut off between said control port and said inlet and relief ports.

7. A pressure reducing and relieving valve as claimed in claim 1, wherein communication between said inlet and control ports is normally closed.

* * * * *